US010995466B1

(12) United States Patent
Alrafaei et al.

(10) Patent No.: US 10,995,466 B1
(45) Date of Patent: May 4, 2021

(54) POLYMER GEO-INJECTION FOR PROTECTING UNDERGROUND STRUCTURES

(71) Applicant: Saudi Arabian Oil Company, Dhahran (SA)

(72) Inventors: Waheed N. Alrafaei, Chester (GB); Thibault Villette, Al-Khobar (SA); Iqbal Hussain, Birmingham (GB)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/799,194

(22) Filed: Feb. 24, 2020

(51) Int. Cl.
*E02D 3/12* (2006.01)
*E21B 4/18* (2006.01)
*E21B 43/267* (2006.01)

(52) U.S. Cl.
CPC ..... *E02D 3/12* (2013.01); *E21B 4/18* (2013.01); *E21B 43/267* (2013.01); *E02D 2250/003* (2013.01); *E02D 2300/0006* (2013.01); *E02D 2600/10* (2013.01)

(58) Field of Classification Search
CPC ..... E21B 4/18; E21B 43/267
See application file for complete search history.

(56) References Cited

U.S. PATENT DOCUMENTS 3,690,106 A * 9/1972 Rhoderio Tregembo ..... E02D 3/12 405/266
4,063,429 A 12/1977 Wilson
4,832,533 A * 5/1989 Ringesten ..... E02D 3/08 405/233
5,836,390 A * 11/1998 Apps ..... C09K 17/12 166/281
5,908,267 A 6/1999 Schuring et al.
(Continued)

FOREIGN PATENT DOCUMENTS

KR 100937237 B1 1/2010
RU 60166 U1 1/2007
WO 2016011060 A1 1/2016

OTHER PUBLICATIONS

Ground, Earth and Soil Stabilisation: Geobear. UK, www.geobear.co.uk/soil-ground-stabilisation/. Accessed Nov. 26, 2019.
(Continued)

*Primary Examiner* — Benjamin F Fiorello
(74) *Attorney, Agent, or Firm* — Leason Ellis LLP

(57) ABSTRACT

A polymer geo-injection apparatus for protecting an underground structure is provided. The apparatus includes: a drill bit configured to drill a path through the ground to a desired depth that is above the underground structure; an injection nozzle coupled to the drill bit and configured to insert into and withdraw from the ground along the drilled path, and to create a corresponding cavity in the ground at the desired depth by injecting compressed air into the ground at the desired depth; and a polymer melting and injection unit configured to fuse or melt one or more components of a solid polymer into a liquid form of the solid polymer, and supply the liquid polymer to the injection nozzle. The injection nozzle is further configured to fabricate a corresponding protection slab of the solid polymer at the desired depth by injecting the supplied liquid polymer into the corresponding cavity.

25 Claims, 10 Drawing Sheets

(56) References Cited

U.S. PATENT DOCUMENTS 5,980,446 A * 11/1999 Loomis ..... B09B 1/00 405/129.45
6,634,831 B2 * 10/2003 Canteri ..... E02D 3/12 405/263
6,801,814 B1 * 10/2004 Wilson ..... E02D 3/12 175/71
6,821,056 B1 * 11/2004 Mansour ..... E02D 27/48 405/230
7,517,177 B2 * 4/2009 Erdemgil ..... E02D 3/12 405/229
7,789,591 B2 9/2010 Hakkinen et al.
8,596,924 B2 * 12/2013 Shimada ..... C09K 17/06 405/269
8,956,083 B2 2/2015 Hakkinen et al.
8,992,130 B2 * 3/2015 Horman ..... E21B 33/138 405/269
9,121,156 B1 9/2015 Calvert
9,200,422 B2 * 12/2015 Hakkinen ..... E02D 5/46
9,512,587 B2 * 12/2016 Arima ..... E02D 3/12
9,988,784 B2 * 6/2018 Barron ..... E02D 5/34
2009/0269146 A1 * 10/2009 Miljovski ..... E02D 5/44 405/233
2013/0129423 A1 * 5/2013 Hakkinen ..... E02D 27/34 405/128.7
2015/0025165 A1 * 1/2015 Chen ..... C08L 53/00 521/140
2017/0030178 A1 * 2/2017 Oehring ..... E21B 43/26
2017/0073919 A1 * 3/2017 Barron ..... G01B 5/30
2019/0120036 A1 * 4/2019 Gullickson ..... E21B 47/06
2019/0186095 A1 6/2019 Eddie et al.
2020/0377788 A1 * 12/2020 Recio, III ..... C09K 8/88

OTHER PUBLICATIONS

DryLander. "Geo-Polymer Slabjacking." Blog Page, Oct. 17, 2017, slabjackgeotechnical.com/blog/geo-polymer-injection/. Accessed Nov. 26, 2019.

* cited by examiner

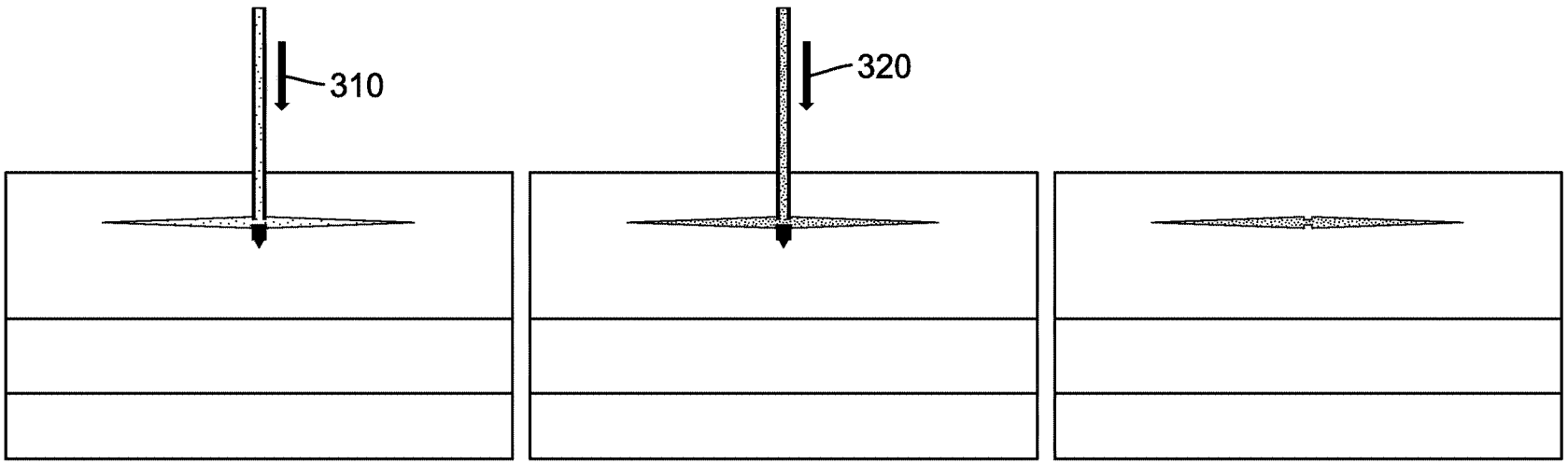
FIG. 3A
FIG. 3B
FIG. 3C
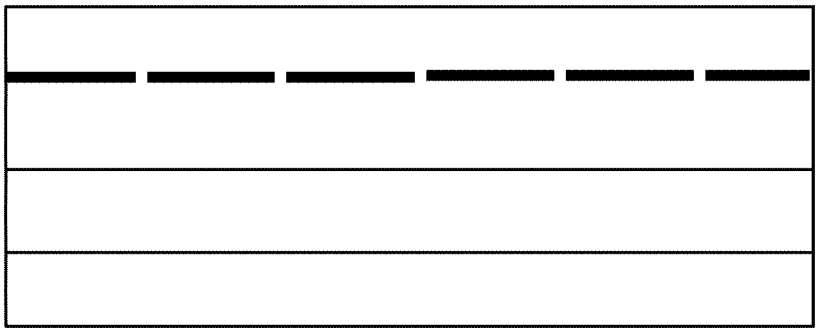
FIG. 3D

600

600

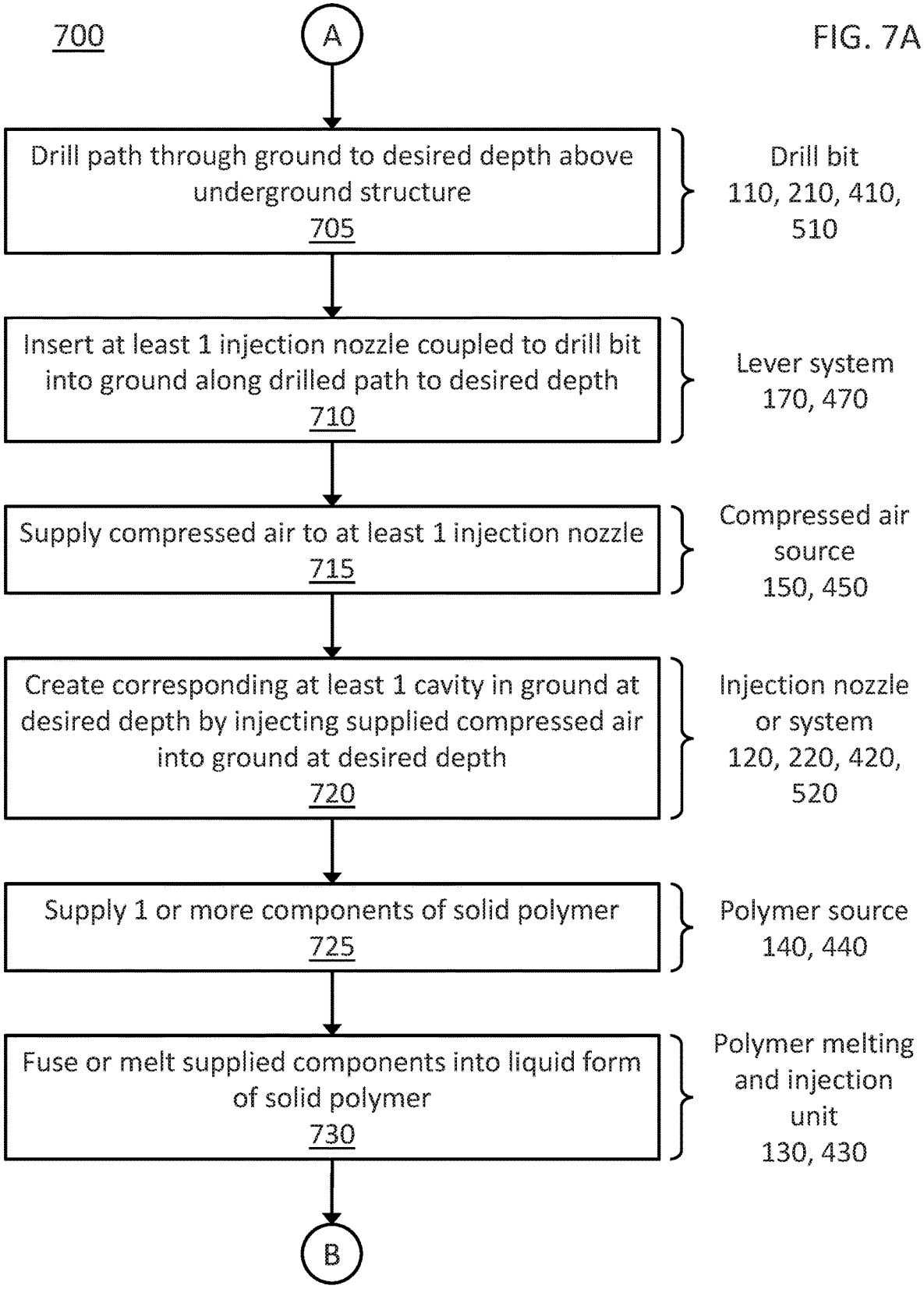
700
A
FIG. 7A
Drill path through ground to desired depth above underground structure
705
Drill bit
110, 210, 410, 510
Insert at least 1 injection nozzle coupled to drill bit into ground along drilled path to desired depth
710
Lever system
170, 470
Supply compressed air to at least 1 injection nozzle
715
Compressed air source
150, 450
Create corresponding at least 1 cavity in ground at desired depth by injecting supplied compressed air into ground at desired depth
720
Injection nozzle or system
120, 220, 420, 520
Supply 1 or more components of solid polymer
725
Polymer source
140, 440
Fuse or melt supplied components into liquid form of solid polymer
730
Polymer melting and injection unit
130, 430
B

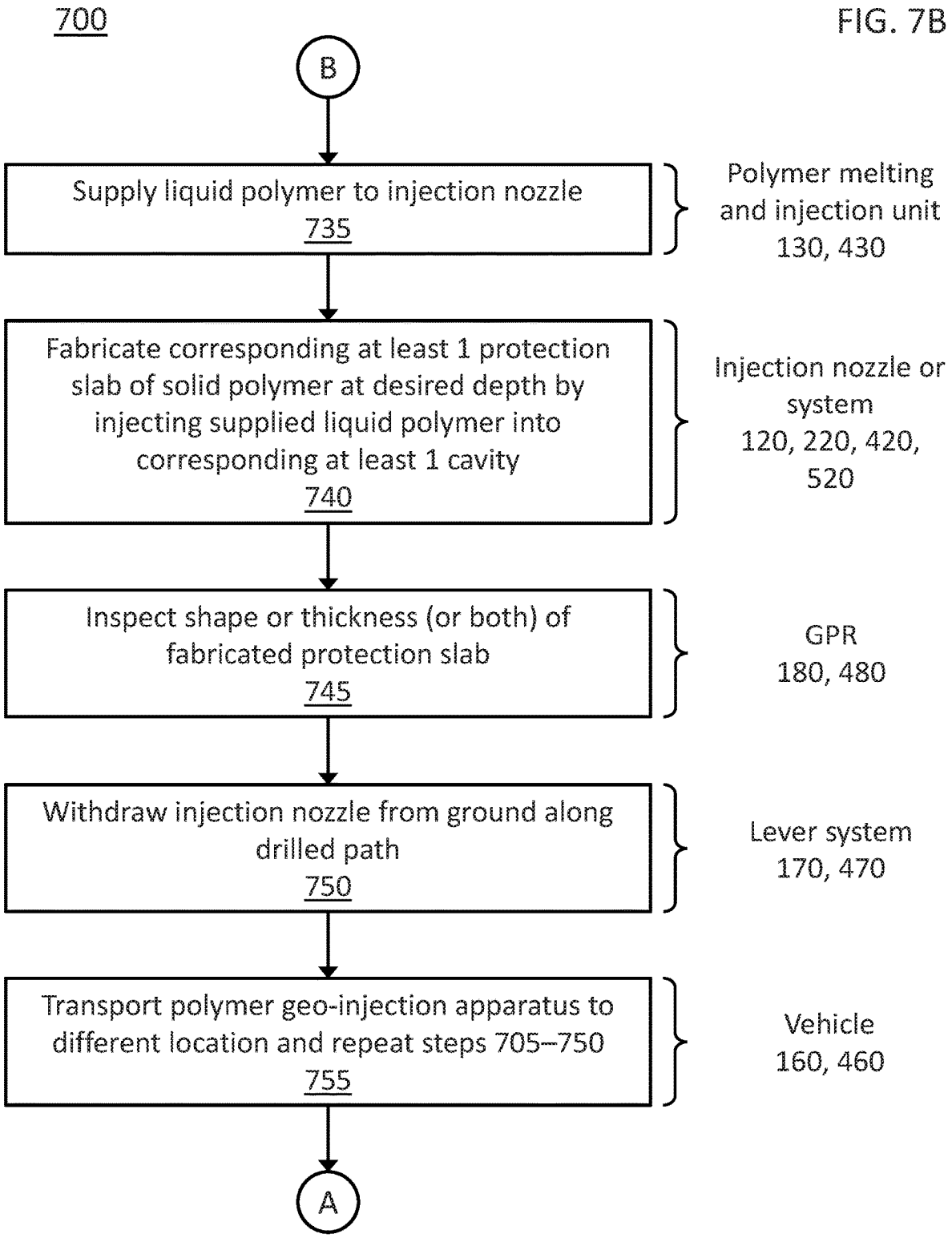
700
FIG. 7B
B
Supply liquid polymer to injection nozzle
735
Polymer melting and injection unit
130, 430
Fabricate corresponding at least 1 protection slab of solid polymer at desired depth by injecting supplied liquid polymer into corresponding at least 1 cavity
740
Injection nozzle or system
120, 220, 420, 520
Inspect shape or thickness (or both) of fabricated protection slab
745
GPR
180, 480
Withdraw injection nozzle from ground along drilled path
750
Lever system
170, 470
Transport polymer geo-injection apparatus to different location and repeat steps 705–750
755
Vehicle
160, 460
A

POLYMER GEO-INJECTION FOR PROTECTING UNDERGROUND STRUCTURES

FIELD OF THE DISCLOSURE

The present disclosure relates in general to polymer geo-injection technologies and, more specifically, to a polymer geo-injection apparatus and method for protecting underground structures such as pipelines and storage tanks.

BACKGROUND OF THE DISCLOSURE

The security and safety around oil and gas transportation pipelines has become an important endeavor. Accidents and resulting damage to such pipelines often arises from third parties, such as by nearby people and their activities that are unrelated to the use or maintenance of the pipelines. When such activity takes place in the vicinity of existing pipelines, and the pipelines are insufficiently identified or insufficiently protected, the pipelines are susceptible to third party damage. This damage is increasing due to the continuing encroachment on existing pipelines by the expanding urbanization of settled areas. Increases in the population and urbanization lead to an increase in development activities including, for example, construction, which increases the likelihood of third party damages. For instance, pipeline failure frequencies in developed areas are four times that of rural areas. Over the years, given the rapidly expanding urban development, many of the pipeline corridors are being encroached upon by business growth and development activities, such as communities, private land development, and private business ventures.

It is in regard to these and other problems in the art that the present disclosure is directed to provide a technical solution for an effective polymer geo-injection apparatus and method for protecting underground structures, such as from third party damage.

SUMMARY OF THE DISCLOSURE

According to an embodiment, a polymer geo-injection apparatus for protecting an underground structure is provided. The apparatus comprises: a drill bit configured to drill a path through the ground to a desired depth that is above the underground structure; at least one injection nozzle coupled to the drill bit and configured to insert into and withdraw from the ground along the drilled path; a compressed air source configured to supply compressed air to the at least one injection nozzle, the at least one injection nozzle being further configured to create a corresponding at least one cavity in the ground at the desired depth by injecting the supplied compressed air into the ground at the desired depth; a polymer source configured to supply one or more components of a solid polymer; and a polymer melting and injection unit coupled to the polymer source and configured to fuse or melt the supplied components into a liquid form of the solid polymer, and supply the liquid polymer to the at least one injection nozzle, the at least one injection nozzle being further configured to fabricate a corresponding at least one protection slab of the solid polymer at the desired depth by injecting the supplied liquid polymer into the corresponding at least one cavity.

In an embodiment, the drilled path is substantially vertical from the surface of the ground to the desired depth.

In an embodiment: the drilled path comprises a lateral portion at the desired depth; the at least one injection nozzle comprises a plurality of injection nozzles; creating the corresponding at least one cavity comprises concurrently creating a corresponding plurality of cavities by injecting the supplied compressed air into the ground along the lateral portion using the plurality of injection nozzles; and fabricating the corresponding at least one protection slab comprises fabricating a corresponding plurality of protection slabs by injecting the supplied liquid polymer into the corresponding plurality of cavities using the plurality of injection nozzles.

In an embodiment, the apparatus further comprises a hose coupled to the at least one injection nozzle and configured to: insert into and withdraw from the ground along the drilled path; and feed the supplied compressed air and the supplied liquid polymer to the at least one injection nozzle.

In an embodiment, the apparatus further comprises a lever system configured to: push the at least one injection nozzle in the ground along the drilled path; and pull the at least one injection nozzle out of the ground along the drilled path.

In an embodiment, the compressed air source comprises a compressed air tank or an air compressor.

In an embodiment: the one or more components comprise the solid polymer; and fusing or melting the supplied components comprises melting the supplied solid polymer into the liquid form of the solid polymer.

In an embodiment: the one or more components comprise two or more components; and fusing or melting the supplied components comprises fusing the supplied two or more components into the liquid form of the solid polymer.

In an embodiment, the underground structure comprises a hydrocarbon pipeline.

In an embodiment, the apparatus further comprises a portable electronic inspection device configured to inspect the shape, thickness, or both the and thickness of the corresponding at least one protection slab.

In an embodiment, the portable electronic inspection device comprises a ground-penetrating radar (GPR).

In an embodiment, the apparatus further comprises: a vehicle configured to transport the drill bit, the at least one injection nozzle, the compressed air source, the polymer source, and the polymer melting and injection unit to a desired location, wherein drilling the path, inserting the at least one injection nozzle, supplying the compressed air, creating the corresponding at least one cavity, supplying the one or more components, fusing or melting the supplied components, supplying the liquid polymer, fabricating the corresponding at least one protection slab, and withdrawing the at least one injection nozzle each comprise using one or more of the transported drill bit, at least one injection nozzle, compressed air source, polymer source, and polymer melting and injection unit while coupled to the vehicle at the desired location.

According to another embodiment, a polymer geo-injection method for protecting an underground structure is provided. The method comprises: drilling a path through the ground to a desired depth above the underground structure using a drill bit; inserting at least one injection nozzle coupled to the drill bit into the ground along the drilled path to the desired depth; supplying compressed air from a compressed air source to the at least one injection nozzle; creating a corresponding at least one cavity in the ground at the desired depth by injecting the supplied compressed air into the ground at the desired depth using the at least one injection nozzle; supplying one or more components of a solid polymer from a polymer source; fusing or melting the supplied components into a liquid form of the solid polymer using a polymer melting and injection unit coupled to the polymer source; supplying the liquid polymer to the at least one injection nozzle using the polymer melting and injection unit; fabricating a corresponding at least one protection slab of the solid polymer at the desired depth by injecting the supplied liquid polymer into the corresponding at least one cavity using the at least one injection nozzle; and withdrawing the at least one injection nozzle from the ground along the drilled path.

In an embodiment, drilling the path comprises drilling the path substantially vertically from the surface of the ground to the desired depth.

In an embodiment: drilling the path comprises drilling a lateral portion of the path at the desired depth; the at least one injection nozzle comprises a plurality of injection nozzles; creating the corresponding at least one cavity comprises concurrently creating a corresponding plurality of cavities by injecting the supplied compressed air into the ground along the lateral portion using the plurality of injection nozzles; and fabricating the corresponding at least one protection slab comprises fabricating a corresponding plurality of protection slabs by injecting the supplied liquid polymer into the corresponding plurality of cavities using the plurality of injection nozzles.

In an embodiment, the method further comprises: inserting a hose coupled to the at least one injection nozzle into the ground along the drilled path; feeding the supplied compressed air to the at least one injection nozzle using the hose; feeding the supplied liquid polymer to the at least one injection nozzle using the hose; and withdrawing the hose from the ground along the drilled path.

In an embodiment, the method further comprises pushing the at least one injection nozzle in the ground along the drilled path using a lever system and pulling the at least one injection nozzle out of the ground along the drilled path using the lever system.

In an embodiment, the compressed air source comprises a compressed air tank or an air compressor.

In an embodiment: the one or more components comprise the solid polymer; and fusing or melting the supplied components comprises melting the supplied solid polymer into the liquid form of the solid polymer.

In an embodiment: the one or more components comprise two or more components; and fusing or melting the supplied components comprises fusing the supplied two or more components into the liquid form of the solid polymer.

In an embodiment, the underground structure comprises a hydrocarbon pipeline.

In an embodiment, the method further comprises inspecting the shape, thickness, or the shape and thickness of the corresponding at least one protection slab using a portable electronic inspection device.

In an embodiment, the portable electronic inspection device comprises a ground-penetrating radar (GPR).

In an embodiment, the method further comprises: transporting the drill bit, the at least one injection nozzle, the compressed air source, the polymer source, and the polymer melting and injection unit to a desired location using a vehicle, wherein drilling the path, inserting the at least one injection nozzle, supplying the compressed air, creating the corresponding at least one cavity, supplying the one or more components, fusing or melting the supplied components, supplying the liquid polymer, fabricating the corresponding at least one protection slab, and withdrawing the at least one injection nozzle each comprise using one or more of the transported drill bit, at least one injection nozzle, compressed air source, polymer source, and polymer melting and injection unit while coupled to the vehicle at the desired location.

In an embodiment, the method further comprises: further transporting the drill bit, the at least one injection nozzle, the compressed air source, the polymer source, and the polymer melting and injection unit to another desired location using the vehicle; and repeating, at the other desired location, drilling the path, inserting the at least one injection nozzle, supplying the compressed air, creating the corresponding at least one cavity, supplying the one or more components, fusing or melting the supplied components, supplying the liquid polymer, fabricating the corresponding at least one protection slab, and withdrawing the at least one injection nozzle each while using one or more of the further transported drill bit, at least one injection nozzle, compressed air source, polymer source, and polymer melting and injection unit while coupled to the vehicle at the other desired location.

Any combinations of the various embodiments and implementations disclosed herein can be used. These and other aspects and features can be appreciated from the following description of certain embodiments together with the accompanying drawings and claims.

BRIEF DESCRIPTION OF THE DRAWINGS

FIGS. 3A through 3D are schematic diagrams illustrating an example polymer geo-injection method for protecting an underground structure, such as a hydrocarbon pipeline or storage tank, suitable for use with a polymer geo-injection apparatus such as the polymer geo-injection apparatus of FIG. 1, according to an embodiment.

FIGS. 7A and 7B are flow diagrams of an example polymer geo-injection method for protecting an underground structure, such as a hydrocarbon pipeline or storage tank, suitable for use with a polymer geo-injection apparatus such as the polymer geo-injection apparatuses of FIGS. 1 and 4, according to an embodiment.

It is noted that the drawings are illustrative and not necessarily to scale, and that the same or similar features have the same or similar reference numerals throughout.

DETAILED DESCRIPTION OF CERTAIN EMBODIMENTS OF THE DISCLOSURE

Figure 1:
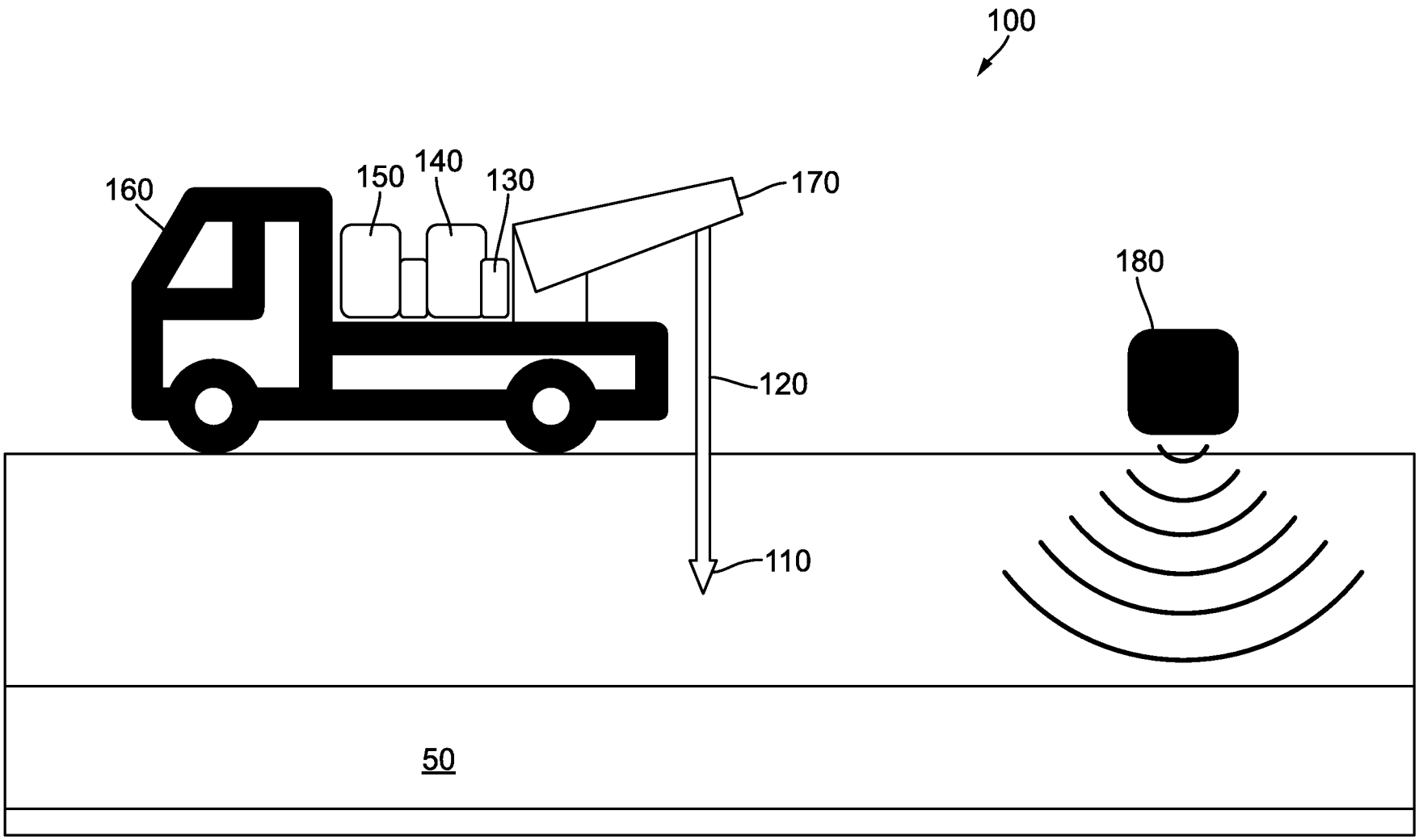
FIG. 1 is a schematic diagram of an example polymer geo-injection apparatus for protecting an underground structure, such as a hydrocarbon pipeline or storage tank, according to an embodiment.

In various example embodiments, a polymer geo-injection apparatus and method for protecting underground structures such as pipelines and storage tanks are provided. In example applications, geo-injection is used to create cavities in the soil above onshore oil and gas pipelines, and to fill the cavities with liquid polymer, such as high-density polyethylene (HDPE). The polymer then hardens to form protective slabs above the pipelines and reinforce the soil strength. The apparatus is portable, and the method is minimally invasive to the ground and surface regions above the protective slabs. This on-site injection molding approach creates high-density polymer slabs that are quite suitable (e.g., high toughness, low cost) for protecting the underground assets. This non-metallic solution reinforces and protects pipeline and other underground structural assets and mitigates encroachment risk from growing population centers. Such an apparatus can also be mounted on a truck and provide for a portable pneumatic injection and composites system suitable for protecting buried assets in different soils and porosities, such as light sand.

As discussed earlier, the increase in urbanization has led to an increase in the amount of third party damage to existing underground structures, such as pipelines and storage tanks. One approach to protecting these structures is to place underground concrete slabs (such as pre-fabricated or casted on-site) over the buried pipelines. However, concrete slabs are heavy, which leads to constraints on the necessary devices (e.g., cranes, trucks) and on the employees operating such devices to carry out the protection. In addition to possible risks from handling such slabs, it is difficult to form them or move them during construction or maintenance of the underground structures. Another approach to protecting these structures is to place underground polymer slabs over the buried pipelines. Polymer slabs provide a number of advantages compared to concrete slabs. In particular, their weight is approximately 1/15 that of concrete slabs for an equivalent surface of protection. This weight savings translates into safer handling and cost savings from less transportation and installation costs (e.g., less fuel), less equipment to handle the slabs (e.g., no crane), and fewer operators required on-site. However, like concrete slabs, there can still be significant installation costs with slabs, such as trench digging, slab installation or forming, and backfilling.

Accordingly, and in example embodiments, a polymer geo-injection apparatus for protecting an underground structure is provided. In one such embodiment, the apparatus includes a truck to transport the geo-injection system and make the system fully mobile. The apparatus further includes several tanks that contain chemicals necessary to manufacture a liquid form of a solid polymer used in forming the protection slabs that protect the underground structures. In addition, the apparatus includes an air compressor to supply compressed air that forms underground cavities above the structures. The apparatus further includes an injection nozzle with an attached drill bit to drill a path through the ground and inject the compressed air and the liquid polymer. In addition, the apparatus includes a lever system to push the injection nozzle in the ground and to pull it out. The apparatus further includes hoses connecting the tanks and air compressor to the injection nozzle to feed the nozzle with the compressed air or the liquid polymer. In addition, the apparatus includes a portable electronic inspection device to inspect, for example, the final shape and thickness of the protection slabs. The apparatus saves cost and time compared to other approaches such as trenching, installing, and back filling concrete or polymer slabs.

In another such embodiment, the apparatus includes a drill bit, at least one injection nozzle coupled to the drill bit, a compressed air source (such as a compressed air tank or an air compressor), a polymer source, and a polymer melting and injection unit coupled to the polymer source. The drill bit is configured to drill a path through the ground to a desired depth that is above the underground structure. The at least one injection nozzle is configured to insert into and withdraw from the ground along the drilled path. The compressed air source is configured to supply compressed air to the at least one injection nozzle. The at least one injection nozzle is further configured to create a corresponding at least one cavity in the ground at the desired depth by injecting the supplied compressed air into the ground at the desired depth. The polymer source is configured to supply one or more components of a solid polymer. The polymer melting and injection unit is configured to fuse or melt the supplied components into a liquid form of the solid polymer, and to supply the liquid polymer to the at least one injection nozzle. To this end, the at least one injection nozzle is further configured to fabricate a corresponding at least one protection slab of the solid polymer at the desired depth by injecting the supplied liquid polymer into the corresponding at least one cavity.

Using such polymer geo-injection techniques as disclosed in the present disclosure helps prevent the need to cut open trenches, remove soil, install slabs, and backfill the trenches. In addition, such techniques of localized manufacturing of pipeline protection systems help prevent the need to order and transport protective systems to the site. Further, such pipeline protection techniques are more efficient and quicker to deploy and complete than comparable trench and backfill solutions. Moreover, some such techniques provide for an integrated system (such as a portable electronic inspection device like a camera or ultrasonic sensor) to allow the operator to check protection slab shape and positioning to be sure they are engineered with the type and magnitude of protection required to protect the assets (e.g., underground pipelines, storage tanks, or other structures).

In some embodiments, systems and methods for injecting a melted polymer into a surface by an injection system in order to fabricate and install underground polymer slabs, and without extensive digging and back filling of earth, are provided. These systems and methods avoid needing to dig and refill pipeline-wide trenches in order to install large, wide slabs. In this way, the systems and methods permit localized and efficient manufacturing and installation of underground materials to protect buried pipelines from inadvertent third-party damage and prevent the need to order and transport protective systems to a pipeline site. Additionally, the geo-injection processes described herein reinforce soil strength for onshore pipeline protection and in the field.

In some embodiments, systems and methods in which an injection system drills into a surface to bore a hole of a desired depth for an injection bar are provided. Thereafter, pumps are used to pass air from a compressed air tank and pass melted polymer material from a polymer tank through hoses within the body of the injection bar to at least one nozzle disposed at the drill head. High pressure air is then injected into the surface to move sediment around to create a corresponding at least one underground cavity. The melted polymer material is then injected into the cavity, whereby it expands and hardens as it cools in the cavity. In this way, the disclosed systems and methods are able to create fabricated polymer slabs at a desired underground location so as to provide protection for buried structures without the need to dig or refill trenches to install pre-fabricated concrete or polymer slabs. Additionally, the systems and methods disclosed herein describe integrated systems in which an operator can review the shape and positioning of the formed protective slabs by onboard electronic inspection devices, such as ground-penetrating radars (GPRs).

In some embodiments, systems and methods requiring fewer operators than alternative methods and that are repeatable without extra labor are provided. For example, the injection bar is removable from the bored hole, and can be repositioned at a new location, where the process is repeated to create a new fabricated polymer slab at the new location. As such, even when moving between locations, these systems and methods avoid the need to dig and back fill trenches, which can take place with comparable concrete and polymer slab technologies.

In one or more implementations, systems and methods directed to vertical drilling systems in which the hole bored is perpendicular to the surface are provided. In one or more implementations, systems and methods directed to horizontal drilling systems, in which the hole bored includes lateral boring at an angle other than perpendicular to the surface, are provided. For example, in some embodiments, horizontal drilling systems bore a vertical hole, utilize a steerable drill bit to change the angle of the hole bore, and then bore laterally in a direction parallel to the surface or protected pipeline. In one or more implementations, systems and methods provide for injection systems in which a plurality of nozzles create a corresponding plurality of cavities, then fill the cavities with melted polymer material. By permitting creation and filling of multiple cavities at once, these systems and methods provide cost and time savings from having to dig multiple trenches, install multiple slabs, and back fill the trenches accordingly.

In some embodiments, the geo-injection path is drilled substantially vertically (such as within 5, 10, or 15 degrees of vertical) with respect to the ground surface. In some such embodiments, after drilling to the desired depth, a substantially horizontal or lateral portion (such as within 5 or 10 degrees of horizontal) with respect to the ground surface or the lateral direction of the pipeline is drilled. Here, the lateral portion is at the desired depth, and the geo-injection is performed in the lateral section. Terms of direction as used herein, such as vertical, lateral, and horizontal, can be with respect to a reference direction, such as a ground surface, a pipeline, or gravity. In some such embodiments, the at least one nozzle includes a plurality of nozzles, and a corresponding plurality of cavities are created in the lateral section by injecting the supplied compressed air into the ground along the lateral portion using the plurality of nozzles. In addition, a corresponding plurality of protection slabs are fabricated by injecting the supplied liquid polymer into the corresponding plurality of cavities using the plurality of injection nozzles.

In some embodiments, the apparatus includes a hose or tube coupled to the at least one injection nozzle and configured to insert into and withdraw from the ground along the drilled path (e.g., using a lever system). The hose or tube is further configured to feed the supplied compressed air and the supplied liquid polymer to the at least one injection nozzle. The lever system is configured to push the at least one injection nozzle in the ground along the drilled path, and pull the at least one injection nozzle out of the ground along the drilled path. In some embodiments, the compressed air source is a compressed air tank or an air compressor. In some embodiments, the one or more components include the solid polymer (such as in a pellet or other solid form), which is melted into the liquid form prior to geo-injection. In some other embodiments, the one or more components include two or more components that are fused into the liquid form of the solid polymer. In some applications, the underground structure is a hydrocarbon (e.g., oil, gas, and their derivatives) pipeline.

In some embodiments, the apparatus further includes a portable electronic inspection device (such as a GPR, a camera, or other sensor, including an infrared sensor or an ultrasonic sensor) configured to inspect the shape or thickness of the fabricated protection slab. In some applications, the apparatus further includes a vehicle (like a truck) that transports the other parts of the apparatus, such as the drill bit, the at least one injection nozzle, the compressed air source, the polymer source, and the polymer melting and injection unit, to a desired location (e.g., above the next portion of the pipeline to be protected). Here, each step of the geo-injection process, such as drilling the path, inserting the at least one injection nozzle, supplying the compressed air, creating the corresponding at least one cavity, supplying the one or more components, fusing or melting the supplied components, supplying the liquid polymer, fabricating the corresponding at least one protection slab, and withdrawing the at least one injection nozzle, includes using one or more of the transported parts while the parts are attached or otherwise coupled to the vehicle. In some such embodiments, after fabricating the protection slab(s) at the desired location, the vehicle moves to the next location (above the next portion of the pipeline to protect) and repeats the process.

FIG. 1 is a schematic diagram of an example polymer geo-injection apparatus 100 for protecting an underground structure, such as a hydrocarbon pipeline 50 or storage tank, according to an embodiment which comprises at least a portion of the concepts explained above. The apparatus 100 includes the following components: a truck 160 to transport the whole geo-injection system (and which makes the system fully mobile); several tanks 140 to contain chemicals necessary for polymer protection manufacturing (e.g., a polymer source); a polymer melting and injection unit 130 to melt or fuse the supplied polymer or chemical components; an air compressor or compressed air tank 150 (e.g., a compressed air source); an injection nozzle 120 with drill bit 110 to drill through the ground and inject the compressed air or melted polymer; a lever system 170 to push the injection nozzle 120 in the ground and pull it out; one or more hoses connecting the tanks 140 and compressor 150 to the injection nozzle 120 to feed the nozzle 120 with compressed air or liquid polymer; and a portable electronic inspection device, such as ground-penetrating radar (GPR) 180, to inspect the final shape and thickness of the protection slab fabricated by the apparatus 100.

In further detail, in some embodiments, the polymer is a high density polyethylene (HDPE) or a polymer concrete mix. In one or more implementations, the polymer includes various catalysts, nucleating agents, aggregates, pigments, or combinations thereof used to achieve desired characteristics of the polymer. For instance, the polymer used can be of a thermoplastic or thermosetting nature. Examples of possible thermoplastics are PE (polyethylene) of low or high density, PP (polypropylene), ABS (acrylonitrile butadiene styrene), PPS (polyphenylene sulfide), PPE (polyphenyl ether), PVC, or thermoplastic polyurethane. Examples of possible thermosetting resins include epoxy, polyester, or polyurethane.

To improve mechanical properties such as stiffness and strength, in some embodiments, the polymer is reinforced with inclusions such as short glass or carbon fiber up to a maximum of 35% in volume. Beyond this volume fraction, rigid inclusions can cause a significant decrease in strength of the material although the stiffness still increases. In some embodiments, inclusions such as carbon black (up to 15%), solid or hollow beads (10 to 30% volume), or elastomeric inclusions (up to 30% volume) are added to provide better impact resistance. The polymer can also be a syntactic foam such as polyurethane or polyester or polypropylene syntactic foam to provide improved properties for shock absorption. In some embodiments, chemical additives are added to control polymer viscosity (saline inclusions in a solution mixed with the polymer). In some embodiments, thermally conductive inclusions such as metallic or carbon inclusions are added (up to 15% volume) to decrease cooling time and get a stiff structure sooner. In some embodiments, when the polymer used is a thermosetting matrix, additives such as thermal oxidizers can be added to accelerate the curing time and get the expected structural stiffness sooner.

The polymer melting and injection unit 130 is coupled to the polymer tank 140 for melting the polymer materials to a sufficiently viscous or liquid form to permit the polymer to flow through the injection nozzle 120 for ultimate delivery below the surface. In one or more implementations, the polymer melting and injection unit 130 operates between 120 degrees Celsius and 260 degrees Celsius, which covers low melting point polymers such as polyethylene (PE) up to high melting point polymers such polyethylene terephtalate (PET).

In some embodiments, the injection system further includes an injection bar. The injection bar facilitates boring into the surface, as well as the delivery of the highly pressurized air and melted polymer to the injection site. The injection bar can be coupled directly to the vehicle 160 or can be arranged separately. In one or more implementations, the injection bar includes one or more hoses or tubes contained within the injection bar for the pressurized air and melted polymer to pass through. In some implementations, a single hose is used to transport both the high pressure air and the melted polymer.

In some such embodiments, the injection bar further includes a drilling mechanism. The drilling mechanism can include a drill head having a drill bit driven by a hammer within the body of the drill head. The drilling mechanism is powered a power source such as a power pack, batteries, or other local current. When activated, the drilling mechanism causes the drill bit to reciprocate and work the surface to displace surface material and thereby bore a hole for the injection bar to enter. The action of the hammer along with the removal of cuttings and the configuration of the drill bit results in rapid progression of the injection bar through homogeneous earthen structures. The drill bit to be used depends on soil structure and properties. For example, for drilling in soft formations, a drill bit with high durability in soft formations should be used. In some embodiments, the size of the drill bits is about 3 inches. Companies such as Smith Bits commercialize appropriate bits such as roller cone drill bits made of high resistance steel and carbide inserts.

In some such embodiments, the polymer injection nozzles are vanes mechanically activated from the surface and located upstream of the bit, and downstream of the injection bar. The injection vanes open and free the molten polymer through the sliding of an internal perforated hose against the perforated injection bar, as illustrated in FIGS. 2A, 2B, 5C, and 5D.

In some implementations, one or more of the drilling mechanism, drill head, and the drill bit are steerable devices. That is, a user can rotate the face of the drilling mechanism to guide the direction of the injection bar to control the route of the bore. Drill steering can be implemented, for example, by a rotary steerable system. In one or more implementations, the drilling mechanism includes a probe for relaying information about the orientation of the drill bit to a user. The probe can be positioned in the drill head to send a radio signal that relates both the position and the orientation of the drill head or drill bit to a receiver on the surface above the bore. The probe, when installed, is keyed to the drill head and the radio signal indicates a relationship of the probe relative to gravity. An operator can then determine the orientation of the drill head to determine which direction the drilling mechanism is drilling to steer the drill head during operation.

In one or more implementations, the drill head houses one or more nozzles for providing delivery of cooling fluid to mitigate drill bit temperature. The injection bar houses one or more nozzles for providing delivery of pressurized air and melted polymer directly to the injection site. The nozzles are coupled to the one or more hoses contained within the injection bar, such as an air hose and a polymer hose. In one or more implementations, the nozzles are inserted into and retracted from the ground as by a lever system. In some such embodiments, the lever system is located on the truck and is used to pull out the injection hose.

In one or more implementations, the system includes an electronic inspection device operated by a user from above the surface to send a radar signal into the surface where the polymer was injected in order to inspect the final shape and thickness of the injected protection slab or slabs. In some such embodiments, ground-penetrating radars (GPRs) are used to perform this inspection. In some other implementations, the inspection device is one or more sensors disposed within or about the injection bar or drilling mechanism and configured to send signals into the earth to determine the extent of the polymer injection. In these implementations, the system is able to integrate topology optimization as a real time process within the manufacturing process or otherwise optimize the polymer injection.

Figure 2B:
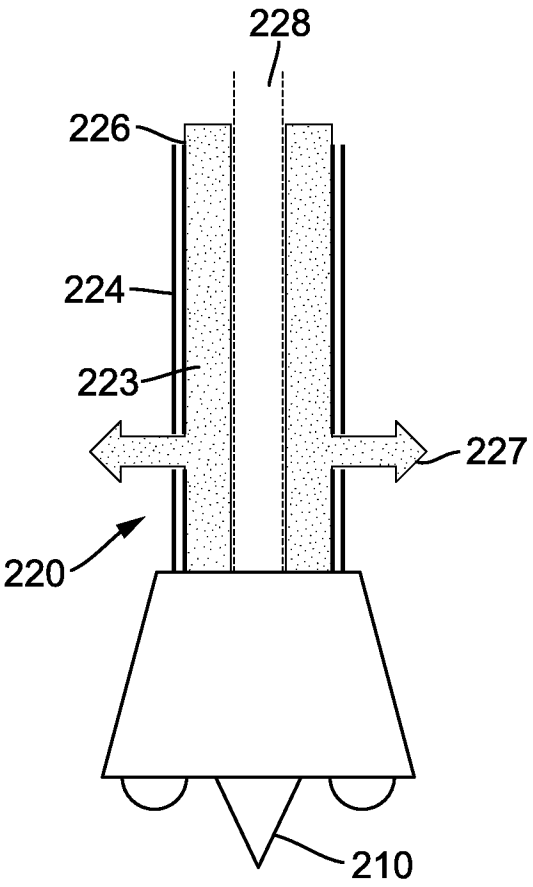
FIGS. 2A and 2B are cross-sectional views of an example drill bit and injection nozzle in a vertical orientation, suitable for use with a polymer geo-injection apparatus such as the polymer geo-injection apparatus of FIG. 1, according to an embodiment.
Figure 2A:
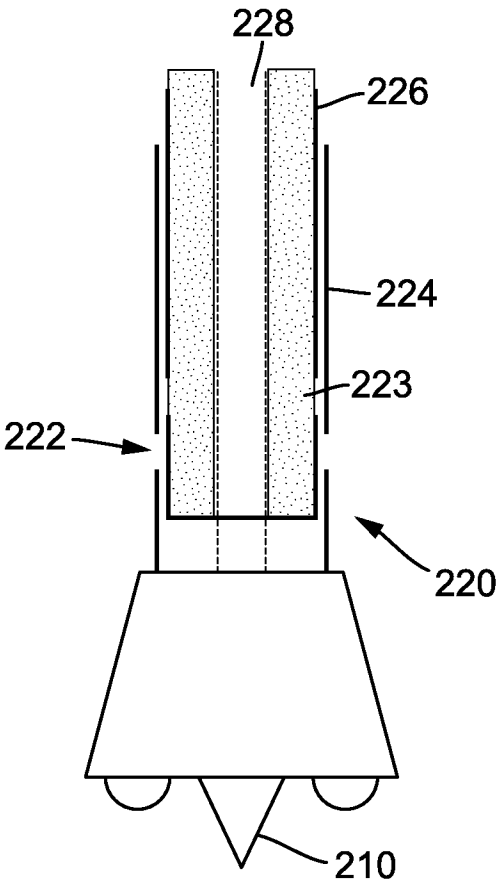

FIGS. 2A and 2B are cross-sectional views of an example drill bit 210 and injection nozzle 220 in a vertical orientation, suitable for use with a polymer geo-injection apparatus such as the polymer geo-injection apparatus 100 of FIG. 1, according to an embodiment. The injection nozzle 220 includes an injection vane 222 for letting molten polymer 223 (or compressed air) flow out, illustrated in FIG. 2B as polymer flowing out 227. The molten polymer 223 is carried to the injection vane 222 through an internal perforated hose 226 with perforation(s) that line up with the injection vane 222 when the hose 226 is down (e.g., close to or in contact with the drill head, as in FIG. 2B). However, the molten polymer 223 is contained by the hose 226 when the hose 226 is up and the perforation(s) are not lined up with the injection vane 222 (e.g., not close to or in contact with the drill head, as in FIG. 2A). The injection nozzle 220 further includes a drilling fluid pipe 228 to transfer cooling fluid to the drill bit 210 when the drill bit 210 is operating. As such, the example of FIGS. 2A and 2B should be understood as being effective to implement at least a portion of the concepts discussed above.

FIGS. 3A through 3D are schematic diagrams illustrating an example polymer geo-injection method 300 for protecting an underground structure, such as a hydrocarbon pipeline or storage tank, suitable for use with a polymer geo-injection apparatus such as the polymer geo-injection apparatus 100 of FIG. 1, according to an embodiment. After drilling to the desired depth (above the pipeline), in FIG. 3A, the method 300 includes the step of injecting high pressure air 310 out the injection nozzle and into the ground to create a cavity in the ground. In FIG. 3B, the method 300 further includes the step of injecting melted polymer 320 into the newly-formed cavity using the injection nozzle. In FIG. 3C, the method 300 further includes the step of removing the injection nozzle, leaving the polymer protection slab formed from the cooling polymer in the cavity. In FIG. 3D, the method 300 further includes repeating these steps at multiple locations over the pipeline to build the protection system over the pipeline, and without trenching, installing, or backfilling. The size and thickness of the protection slabs can be determined nondestructively using a portable electronic inspection device, such as a GPR device.

Figure 4:
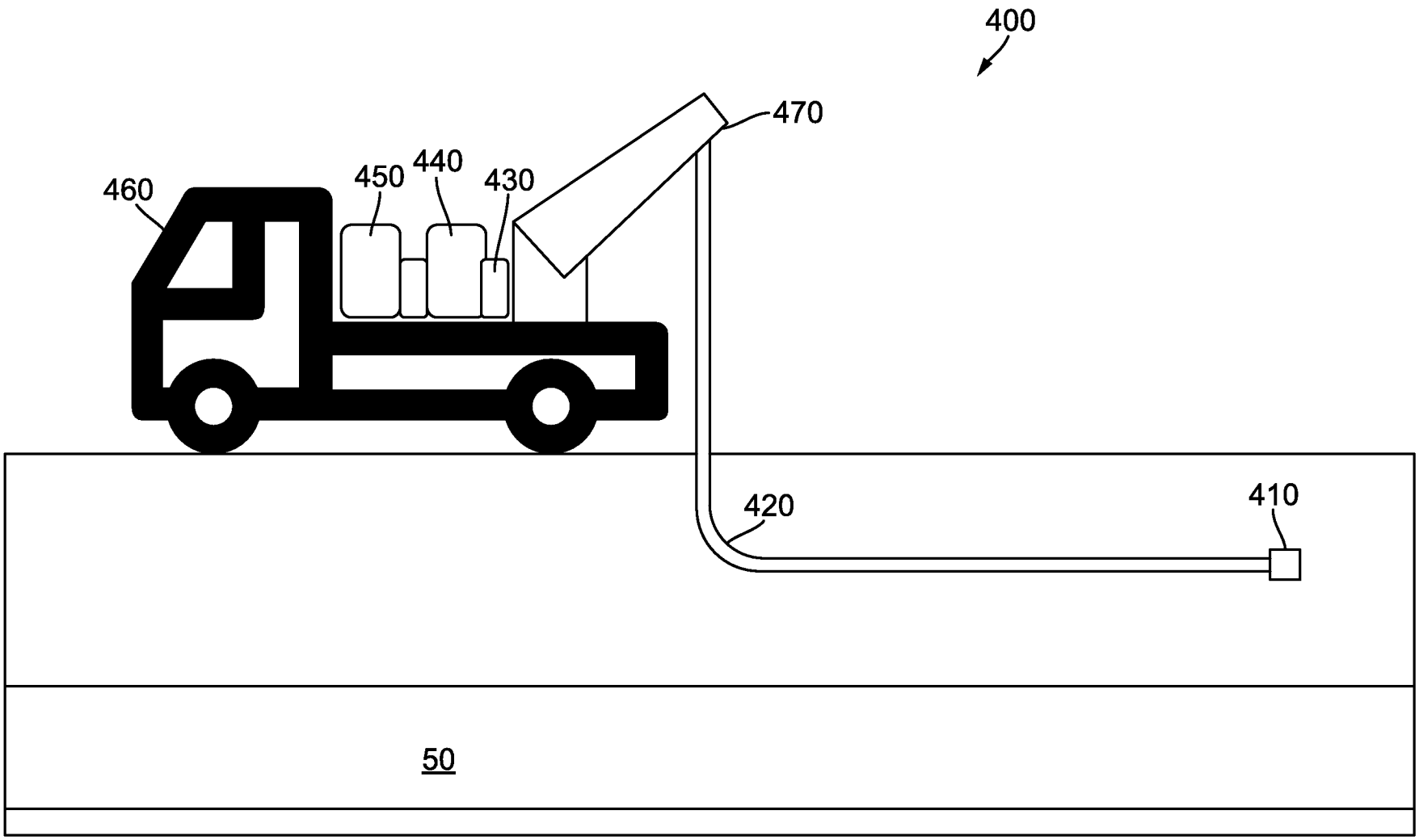
FIG. 4 is a schematic diagram of an example polymer geo-injection apparatus for protecting an underground structure, such as a hydrocarbon pipeline or storage tank, according to another embodiment.

FIG. 4 is a schematic diagram of an example polymer geo-injection apparatus 400 for protecting an underground structure, such as a hydrocarbon pipeline or storage tank, according to another embodiment. The apparatus 400 includes the following components: a truck 460 to transport the whole geo-injection system (and which makes the system fully mobile); several tanks 440 to contain chemicals necessary for polymer protection manufacturing (e.g., a polymer source); a polymer melting and injection unit 430 to melt or fuse the supplied polymer or chemical components; an air compressor or compressed air tank 450 (e.g., a compressed air source); and a lateral injection system 420 having a plurality of nozzles coupled to a drill bit 410 and configured to drill through the ground and inject the compressed air or melted polymer. The apparatus 400 further includes a lever system 470 to push the injection system 420 in the ground and pull it out, along with one or more hoses connecting the tanks 440 and compressor 450 to the injection system 420 in order to feed the nozzles with compressed air or liquid polymer. The apparatus 400 further includes a portable electronic inspection device, such as a portable GPR device 480 (illustrated in FIG. 6B), to inspect the final shape and thickness of the protection slabs fabricated by the apparatus 400. As such, the example of FIG. 4 should be understood as being effective to implement at least a portion of the concepts discussed above.

Figure 5A:
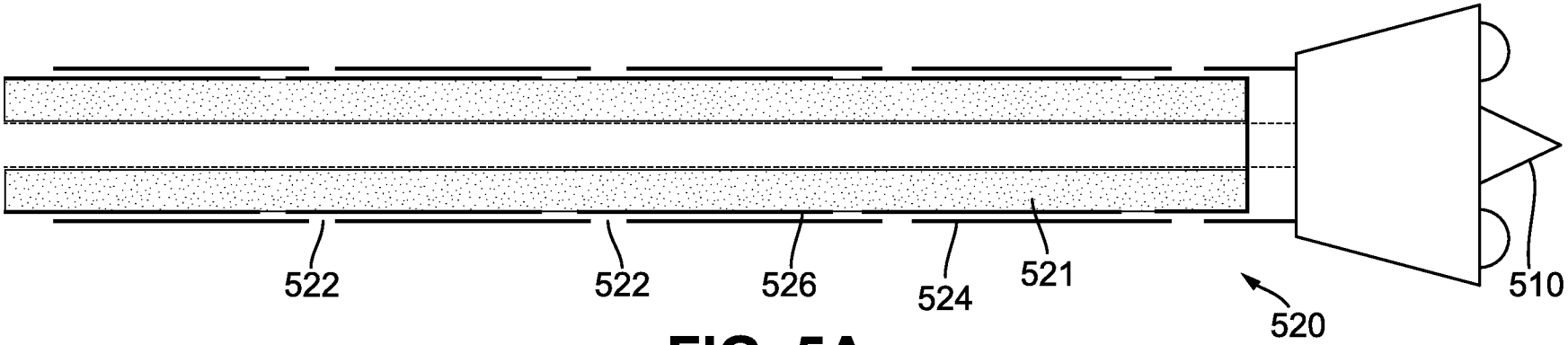
FIGS. 5A through 5D are cross-sectional views of an example drill bit and injection system in a horizontal orientation, suitable for use with a polymer geo-injection apparatus such as the polymer geo-injection apparatus of FIG. 4, according to an embodiment.
Figure 5B:
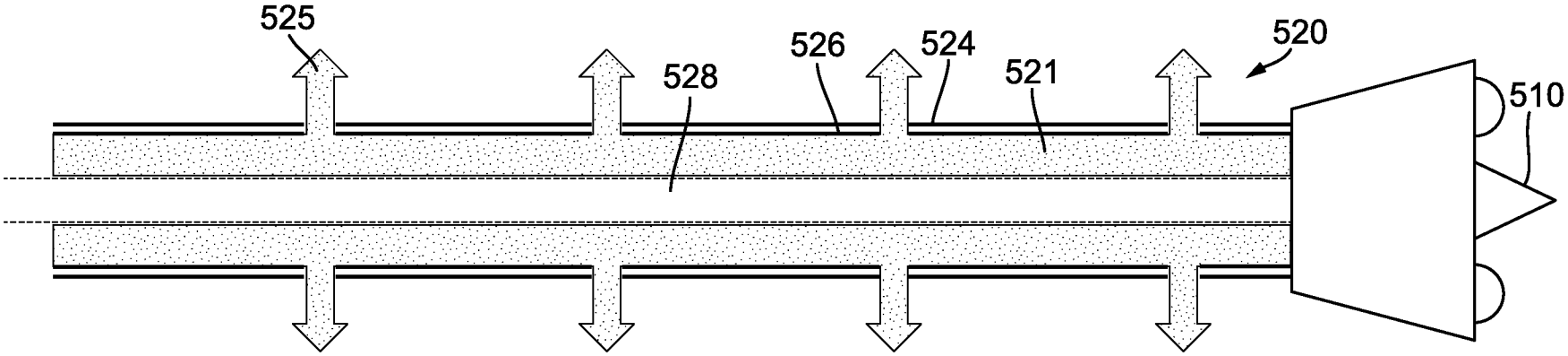
Figure 5C:
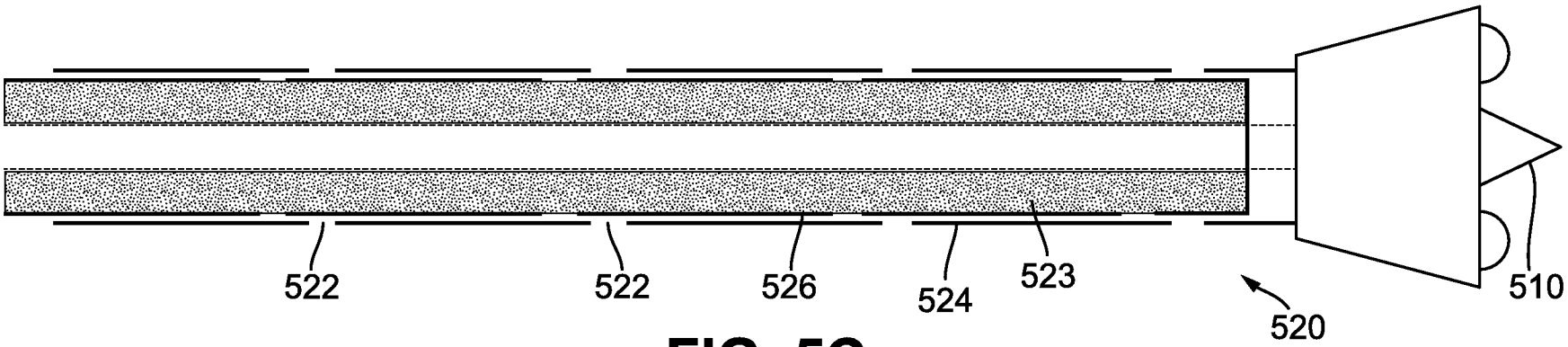
Figure 5D:
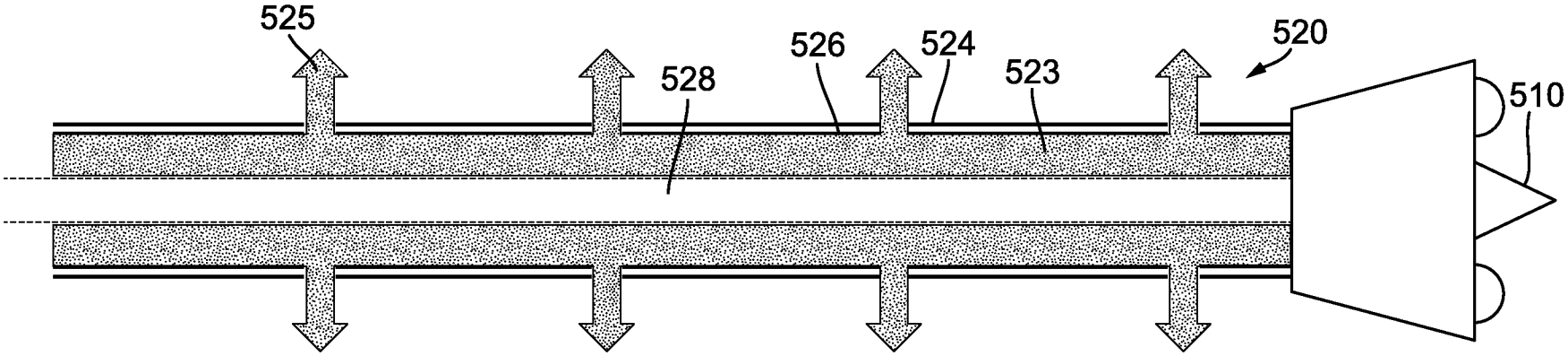

FIGS. 5A through 5D are cross-sectional views of an example drill bit 510 and injection system 520 in a horizontal orientation, suitable for use with a polymer geo-injection apparatus such as the polymer geo-injection apparatus 400 of FIG. 4, according to an embodiment. The injection system 520 includes a plurality of injection nozzles, each formed from a corresponding injection vane 522 for letting compressed air 521 blow out or molten polymer 523 flow out. This is illustrated in FIG. 5B as compressed air blowing out 525 and in FIG. 5D as polymer flowing out 527. The compressed air 521 is carried to the injection vanes 522 through an internal perforated hose 526 with perforations that line up with the injection vanes 522 when the hose 526 is down (e.g., close to or in contact with the drill head, as in FIG. 5B). However, the compressed air 521 is contained by the hose 526 when the hose 526 is up and the perforations are not lined up with the injection vanes 522 (e.g., not close to or in contact with the drill head, as in FIG. 5A). Likewise, the molten polymer 523 is carried to the injection vanes 522 through the internal perforated hose 526 when the hose 526 is down (e.g., FIG. 5D). However, the molten polymer 523 is contained by the hose 526 when the hose 526 is up (e.g., FIG. 5C). The injection system 520 further includes a drilling fluid pipe 528 to transfer cooling fluid to the drill bit 510 when the drill bit 510 is operating.

Figure 6A:
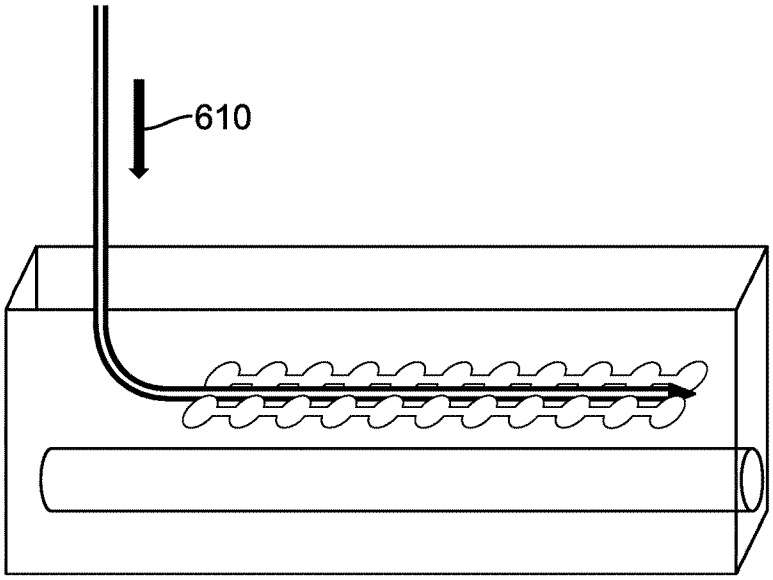
FIGS. 6A through 6D are schematic diagrams illustrating an example polymer geo-injection method for protecting an underground structure, such as a hydrocarbon pipeline or storage tank, suitable for use with a polymer geo-injection apparatus such as the polymer geo-injection apparatus of FIG. 4, according to an embodiment.
Figure 6B:
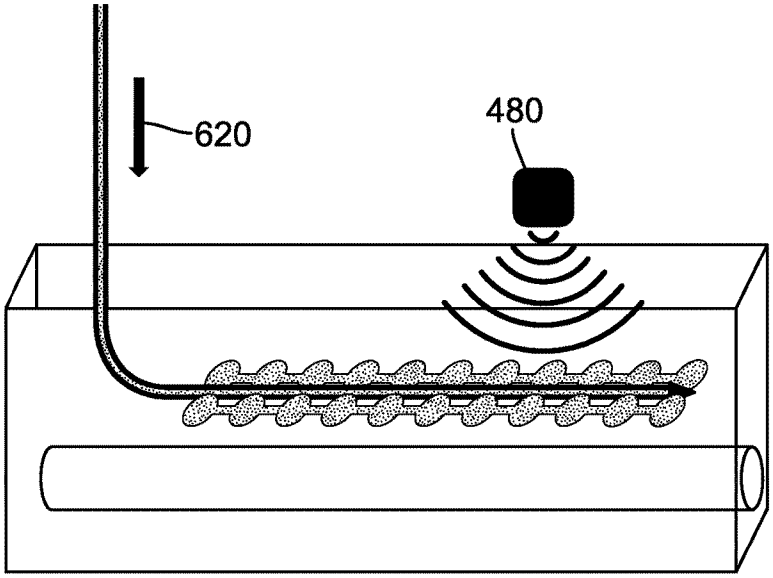

FIGS. 6A through 6D are schematic diagrams illustrating an example polymer geo-injection method 600 for protecting an underground structure, such as a hydrocarbon pipeline or storage tank, suitable for use with a polymer geo-injection apparatus such as the polymer geo-injection apparatus 400 of FIG. 4, according to an embodiment. After drilling to the desired depth and lateral extension (above the pipeline), in FIG. 6A, the method 600 includes the step of injecting high pressure air 610 out the injection nozzles and into the ground to create corresponding cavities in the ground. In FIG. 6B, the method 600 further includes the step of injecting fused polymer 620 (such as liquid polymer formed from two or more component compounds fused together with heat) into the newly-formed cavities using the injection nozzles.

Figure 6C:
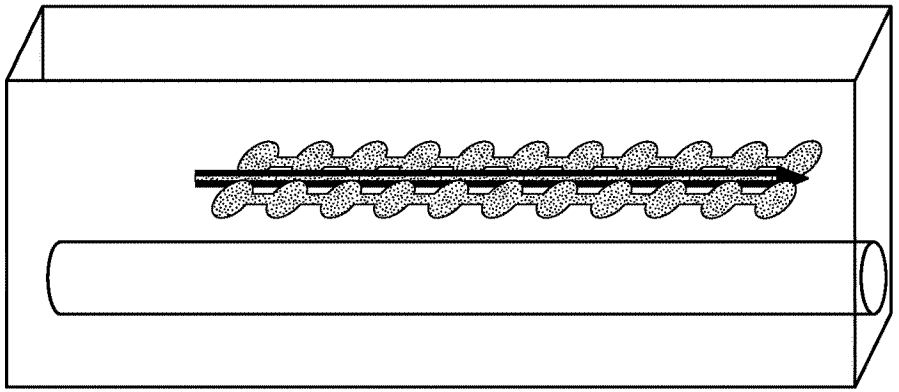
Figure 6D:
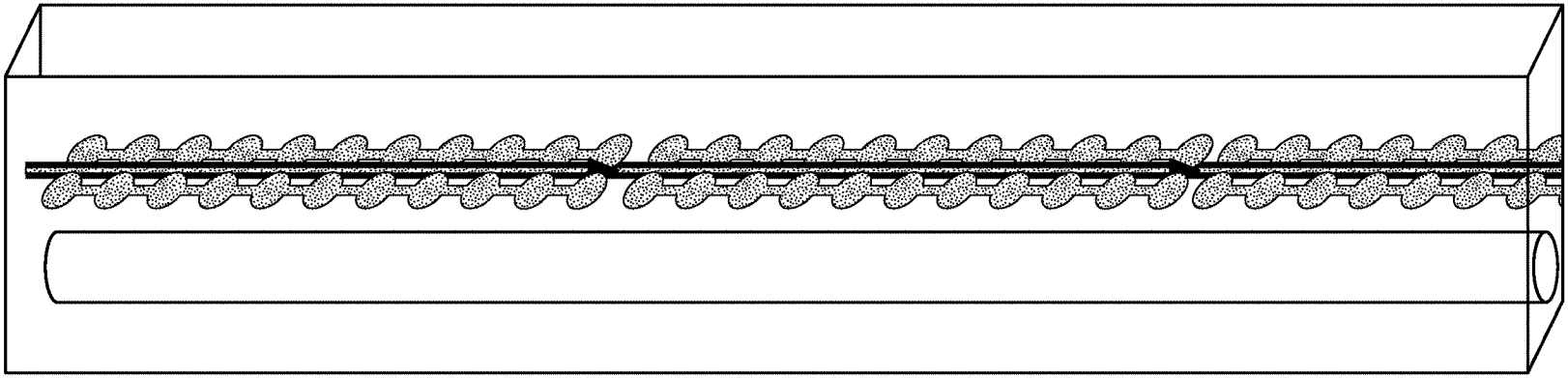

At this or a later point, a portable electronic inspection device (such as portable GPR device 480), can be used to inspect the shape or thickness of the polymer slabs, such as to make sure their shape or thickness is appropriate for the protection they are to provide. In FIG. 6C, the method 600 further includes the step of removing the injection system, leaving the corresponding polymer protection slabs formed from the cooling polymer in the cavities. In FIG. 6D, the method 600 further includes repeating these steps at multiple locations over the pipeline to build the protection system over the pipeline, and without trenching, installing, or backfilling.

FIGS. 7A and 7B are flow diagrams of an example polymer geo-injection method 700 for protecting an underground structure, such as a hydrocarbon pipeline (e.g., hydrocarbon pipeline 50) or storage tank, suitable for use with a polymer geo-injection apparatus such as the polymer geo-injection apparatuses 100 and 400 of FIGS. 1 and 4, respectively, according to an embodiment, and which, more generally, will be understood by persons in the art as implementing at least a portion of the concepts discussed above.

Some or all of the method 700 (and any other method described herein) can be performed using components and techniques illustrated in FIGS. 1 through 6D. Portions of this and other methods disclosed herein can be performed on or using a custom or preprogrammed logic device, circuit, or processor, such as a programmable logic circuit (PLC), computer, software, or other circuit (e.g., ASIC, FPGA) configured by code or logic to carry out their assigned task. The device, circuit, or processor can be, for example, a dedicated or shared hardware device (such as a laptop, a single board computer (SBC), a workstation, a tablet, a smartphone, part of a server, or a dedicated hardware circuit, as in an FPGA or ASIC, or the like), or computer server, or a portion of a server or computer system. The device, circuit, or processor can include a non-transitory computer readable medium (CRM, such as read-only memory (ROM), flash drive, or disk drive) storing instructions that, when executed on one or more processors, cause portions of the method 700 (or other disclosed method) to be carried out. It should be noted that in other embodiments, the order of the operations can be varied, and that some of the operations can be omitted. Some or all of the method 700 can also be performed using logic, circuits, or processors located on or in electrical communication with a platform configured to carry out the method 700.

Prior to starting the example method 700 as shown in FIG. 7A, the step of transporting the polymer geo-injection apparatus (such as polymer geo-injection apparatus 100 or 400) to a desired location using a vehicle (such as truck 160 or 460) is performed. The method 700 as shown in FIG. 7A then begins with the step of drilling 705 a path (e.g., vertical, lateral) through the ground to a desired depth above the underground structure (such as hydrocarbon pipeline 50) using a drill bit (such as drill bit 110, 210, 410, or 510). The method 700 further includes the step of inserting 710 at least one injection nozzle (such as injection nozzle 120 or 220, or injection system 420 or 520) coupled to the drill bit into the ground along the drilled path to the desired depth. For instance, the at least one injection nozzle can be inserted into the ground using a lever system (such as lever system 170 or 470). In addition, the method 700 includes the step of supplying 715 compressed air from a compressed air source (such as a compressed air tank or air compressor, as in compressed air source 150 or 450) to the at least one injection nozzle.

The method 700 further includes the step of creating 720 a corresponding at least one cavity in the ground at the desired depth by injecting the supplied compressed air into the ground at the desired depth using the at least one injection nozzle. See, for example, FIGS. 3A and 6A. In addition, the method 700 includes the step of supplying 725 one or more components of a solid polymer from a polymer source (such as polymer source 140 or 440). The method 700 further includes the step of fusing or melting 730 the supplied components into a liquid form of the solid polymer using a polymer melting and injection unit (such as polymer melting and injection unit 130 or 430) coupled to the polymer source. In addition, the method 700 includes the step of supplying 735 the liquid polymer to the at least one injection nozzle using the polymer melting and injection unit.

The method 700 further includes the step of fabricating 740 a corresponding at least one protection slab of the solid polymer at the desired depth by injecting the supplied liquid polymer into the corresponding at least one cavity using the at least one injection nozzle. See, for example, FIGS. 3B and 6B. In addition, the method 700 includes the step of inspecting 745 the shape, thickness, or the shape and thickness of the fabricated protection slab using a portable electronic inspection device (such as GPR 180 or 480). The method 700 further includes the step of withdrawing 750 the at least one injection nozzle from the ground along the drilled path (such as using the lever system 170 or 470). See, for example, FIGS. 3C and 6C. In addition, the method 700 includes the step of further transporting 755 the polymer geo-injection apparatus (e.g., the drill bit, the at least one injection nozzle, the compressed air source, the polymer source, the polymer melting and injection unit, the lever system, and the GPR) to another desired location (such as next to the present location) using the vehicle, and repeating steps 705 through 755. See, for example, FIGS. 3D and 6D.

The methods described herein may be performed in part or in full by software or firmware in machine readable form on a tangible (e.g., non-transitory) storage medium. For example, the software or firmware may be in the form of a computer program including computer program code adapted to perform some or all of the steps of any of the methods described herein when the program is run on a computer or suitable hardware device (e.g., FPGA), and where the computer program may be embodied on a computer readable medium. Examples of tangible storage media include computer storage devices having computer-readable media such as disks, thumb drives, flash memory, and the like, and do not include propagated signals. Propagated signals may be present in a tangible storage media, but propagated signals by themselves are not examples of tangible storage media. The software can be suitable for execution on a parallel processor or a serial processor such that the method steps may be carried out in any suitable order, or simultaneously.

It is to be further understood that like or similar numerals in the drawings represent like or similar elements through the several figures, and that not all components or steps described and illustrated with reference to the figures are required for all embodiments or arrangements.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It is further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to a viewer. Accordingly, no limitations are implied or to be inferred. In addition, the use of ordinal numbers (e.g., first, second, third) is for distinction and not counting. For example, the use of "third" does not imply there is a corresponding "first" or "second." Also, the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

The subject matter described above is provided by way of illustration only and should not be construed as limiting. Various modifications and changes can be made to the subject matter described herein without following the example embodiments and applications illustrated and described, and without departing from the true spirit and scope of the invention encompassed by the present disclosure, which is defined by the set of recitations in the following claims and by structures and functions or steps which are equivalent to these recitations.

What is claimed is:

1. A polymer geo-injection apparatus for protecting an underground structure, the apparatus comprising:

a drill bit configured to drill a path through the ground to a desired depth that is above the underground structure;

at least one injection nozzle coupled to the drill bit and configured to insert into and withdraw from the ground along the drilled path;

a compressed air source configured to supply compressed air to the at least one injection nozzle, the at least one injection nozzle being further configured to create a corresponding at least one cavity in the ground at the desired depth by injecting the supplied compressed air into the ground at the desired depth;

a polymer source configured to supply one or more components of a solid polymer; and a polymer melting and injection unit coupled to the polymer source and configured to fuse or melt the supplied components into a liquid form of the solid polymer, and supply the liquid polymer to the at least one injection nozzle, the at least one injection nozzle being further configured to fabricate a corresponding at least one protection slab of the solid polymer at the desired depth by injecting the supplied liquid polymer into the corresponding at least one cavity.

2. The apparatus of claim 1, wherein the drilled path is substantially vertical from the surface of the ground to the desired depth.

3. The apparatus of claim 1, wherein:

the drilled path comprises a lateral portion at the desired depth;

the at least one injection nozzle comprises a plurality of injection nozzles;

creating the corresponding at least one cavity comprises concurrently creating a corresponding plurality of cavities by injecting the supplied compressed air into the ground along the lateral portion using the plurality of injection nozzles; and fabricating the corresponding at least one protection slab comprises fabricating a corresponding plurality of protection slabs by injecting the supplied liquid polymer into the corresponding plurality of cavities using the plurality of injection nozzles.

4. The apparatus of claim 1, further comprising a hose coupled to the at least one injection nozzle and configured to:

insert into and withdraw from the ground along the drilled path; and feed the supplied compressed air and the supplied liquid polymer to the at least one injection nozzle.

5. The apparatus of claim 1, further comprising a lever system configured to:

push the at least one injection nozzle in the ground along the drilled path; and pull the at least one injection nozzle out of the ground along the drilled path.

6. The apparatus of claim 1, wherein the compressed air source comprises a compressed air tank or an air compressor.

7. The apparatus of claim 1, wherein:

the one or more components comprise the solid polymer; and fusing or melting the supplied components comprises melting the supplied solid polymer into the liquid form of the solid polymer.

8. The apparatus of claim 1, wherein:

the one or more components comprise two or more components; and fusing or melting the supplied components comprises fusing the supplied two or more components into the liquid form of the solid polymer.

9. The apparatus of claim 1, wherein the underground structure comprises a hydrocarbon pipeline.

10. The apparatus of claim 1, further comprising a portable electronic inspection device configured to inspect the shape, thickness, or the shape and thickness of the corresponding at least one protection slab.

11. The apparatus of claim 10, wherein the portable electronic inspection device comprises a ground-penetrating radar (GPR).

12. The apparatus of claim 1, further comprising:

a vehicle configured to transport the drill bit, the at least one injection nozzle, the compressed air source, the polymer source, and the polymer melting and injection unit to a desired location, wherein drilling the path, inserting the at least one injection nozzle, supplying the compressed air, creating the corresponding at least one cavity, supplying the one or more components, fusing or melting the supplied components, supplying the liquid polymer, fabricating the corresponding at least one protection slab, and withdrawing the at least one injection nozzle each comprise using one or more of the transported drill bit, at least one injection nozzle, compressed air source, polymer source, and polymer melting and injection unit while coupled to the vehicle at the desired location.

13. A polymer geo-injection method for protecting an underground structure, the method comprising:

drilling a path through the ground to a desired depth above the underground structure using a drill bit, inserting at least one injection nozzle coupled to the drill bit into the ground along the drilled path to the desired depth;

supplying compressed air from a compressed air source to the at least one injection nozzle;

creating a corresponding at least one cavity in the ground at the desired depth by injecting the supplied compressed air into the ground at the desired depth using the at least one injection nozzle;

supplying one or more components of a solid polymer from a polymer source;

fusing or melting the supplied components into a liquid form of the solid polymer using a polymer melting and injection unit coupled to the polymer source;

supplying the liquid polymer to the at least one injection nozzle using the polymer melting and injection unit;

fabricating a corresponding at least one protection slab of the solid polymer at the desired depth by injecting the supplied liquid polymer into the corresponding at least one cavity using the at least one injection nozzle; and withdrawing the at least one injection nozzle from the ground along the drilled path.

14. The method of claim 13, wherein drilling the path comprises drilling the path substantially vertically from the surface of the ground to the desired depth.

15. The method of claim 13, wherein:

drilling the path comprises drilling a lateral portion of the path at the desired depth;

the at least one injection nozzle comprises a plurality of injection nozzles;

creating the corresponding at least one cavity comprises concurrently creating a corresponding plurality of cavities by injecting the supplied compressed air into the ground along the lateral portion using the plurality of injection nozzles; and fabricating the corresponding at least one protection slab comprises fabricating a corresponding plurality of protection slabs by injecting the supplied liquid polymer into the corresponding plurality of cavities using the plurality of injection nozzles.

16. The method of claim 13, further comprising:

inserting a hose coupled to the at least one injection nozzle into the ground along the drilled path;

feeding the supplied compressed air to the at least one injection nozzle using the hose;

feeding the supplied liquid polymer to the at least one injection nozzle using the hose; and withdrawing the hose from the ground along the drilled path.

17. The method of claim 13, further comprising:

pushing the at least one injection nozzle in the ground along the drilled path using a lever system; and pulling the at least one injection nozzle out of the ground along the drilled path using the lever system.

18. The method of claim 13, wherein the compressed air source comprises a compressed air tank or an air compressor.

19. The method of claim 13, wherein:

the one or more components comprise the solid polymer; and fusing or melting the supplied components comprises melting the supplied solid polymer into the liquid form of the solid polymer.

20. The method of claim 13, wherein:

the one or more components comprise two or more components; and fusing or melting the supplied components comprises fusing the supplied two or more components into the liquid form of the solid polymer.

21. The method of claim 13, wherein the underground structure comprises a hydrocarbon pipeline.

22. The method of claim 13, further comprising inspecting the shape, thickness, or the shape and thickness of the fabricated protection slab using a portable electronic inspection device.

23. The method of claim 22, wherein the portable electronic inspection device comprises a ground-penetrating radar (GPR).

24. The method of claim 13, further comprising:

transporting the drill bit, the at least one injection nozzle, the compressed air source, the polymer source, and the polymer melting and injection unit to a desired location using a vehicle, wherein drilling the path, inserting the at least one injection nozzle, supplying the compressed air, creating the corresponding at least one cavity, supplying the one or more components, fusing or melting the supplied components, supplying the liquid polymer, fabricating the corresponding at least one protection slab, and withdrawing the at least one injection nozzle each comprise using one or more of the transported drill bit, at least one injection nozzle, compressed air source, polymer source, and polymer melting and injection unit while coupled to the vehicle at the desired location.

25. The method of claim 24, further comprising:

further transporting the drill bit, the at least one injection nozzle, the compressed air source, the polymer source, and the polymer melting and injection unit to another desired location using the vehicle; and repeating, at the other desired location, drilling the path, inserting the at least one injection nozzle, supplying the compressed air, creating the corresponding at least one cavity, supplying the one or more components, fusing or melting the supplied components, supplying the liquid polymer, fabricating the corresponding at least one protection slab, and withdrawing the at least one injection nozzle each while using one or more of the further transported drill bit, at least one injection nozzle, compressed air source, polymer source, and polymer melting and injection unit while coupled to the vehicle at the other desired location.

* * * * *